United States Patent [19]

Vrijssen

[11] Patent Number: 4,868,455

[45] Date of Patent: Sep. 19, 1989

[54] ELECTRON BEAM DEVICE WITH AN ELECTRON GUN HAVING A TUBULAR INSULATING ELECTRODE SUPPORT

[75] Inventor: Gerardus A. H. M. Vrijssen, Eindhoven, Netherlands

[73] Assignee: U.S. Philips Corporation, New York, N.Y.

[21] Appl. No.: 168,848

[22] Filed: Mar. 16, 1988

[30] Foreign Application Priority Data

Mar. 25, 1987 [GB] United Kingdom ..... 8707170

[51] Int. Cl.[4] ..... H01J 29/48; H01J 29/90; H01J 29/92

[52] U.S. Cl. ..... 313/451; 313/450; 313/456; 313/460; 313/477 R; 313/482

[58] Field of Search ..... 313/450, 451, 456, 460, 313/477, 482

[56] References Cited

U.S. PATENT DOCUMENTS 2,828,433 3/1958 Frenkel ..... 313/482

4,607,190 8/1986 Himmelbauer ..... 313/482 X 4,713,879 12/1987 Vrijssen ..... 313/450 X

*Primary Examiner*—Palmer C. DeMeo

*Attorney, Agent, or Firm*—Robert J. Kraus

[57] ABSTRACT

An electron beam device such as a cathode ray tube having an electron gun (15) comprising a profiled tubular body (22) of a vitreous material. At least some of the electrodes (30, 32, 34, 36) of the electron gun comprising cup-shaped drawn metal members which are push fitted against respective engaging surfaces formed in the tubular body (22). Electrical connections to one or more of these cup-shaped members are point contacts made with lead-out wires (38, 40) held captive in the wall of the tubular body (22). In order to ensure a good point contact, at least the area of the wall in the vicinity of the terminal portion of the or each lead-out wire is flat. In consequence thereof a skirted portion of the or each cup-shaped electrode is flattened slightly against the surface of the wall.

12 Claims, 5 Drawing Sheets

ELECTRON BEAM DEVICE WITH AN ELECTRON GUN HAVING A TUBULAR INSULATING ELECTRODE SUPPORT

BACKGROUND OF THE INVENTION

The present invention relates to an electron beam device comprising an evacuated envelope formed by optically transparent faceplate, a conical portion and a neck, an electron gun within the evacuated envelope comprising a tubular body of an insulating material in which there are provided some generally cup-shaped electrodes and an electrical connection to at least one cup-shaped electrode carried by the wall of the tubular body.

In the present specification the term electron beam device is to be understood to include cathode ray tubes, X-ray tubes, electron beam lithography apparatus, scanning and transmission electron microscopes, electron guns for scanning Auger mass spectrometers and also ion guns (not an electron beam discharge device within the normal meaning of the term). For convenience of description, the electron beam device will be described with reference to a cathode ray tube.

European Patent Application No. 86200481.9 discloses a cathod ray tube having an electron gun consisting of a vitreous tubular envelope formed by heating and drawing under reduced pressure onto a bipartite, profiled suction mandril. An end portion of the tubular body has a plurality of steps of decreasing radius. The steps form abutments or reference surface against which drawn, cup-shaped form abutments or reference surface against which drawn, cupshaped metal electrodes bear. The metal electrodes are of a sufficiently thin material that they can adapt to the cross-section of the stepped portion into which it is received. At least the terminal portions of the electrical connections to some of the drawn metal electrodes, namely those which cannot have a lead-out through the open end of the tubular body, are held captive in the wall of the tubular body. A main focusing lens is formed by a helix of an electrically resistive material to which electrical connections are made.

A problem which can occur with electrical connection(s) to the cup-shaped metal electrode(s) is that when deep drawing these electrodes, the skirted portion, the lip of which bears against the surface of the stepped portion, is conical rather than truly cylindrical. As the electrical contact between the terminal portion of a lead-out and the electrode is essentially a point-contact, then in an extreme case the conicity of the skirted portion may be such that the point-contact is not established. This problem can be very inconvenient because unless the fault can be rectified it may mean discarding the complete electron gun. Since the insertion of the cup-shaped electrodes is in the final phase of manufacture, which phase has been preceded by the more expensive operation of providing a resistive layer in the main focusing part of the electron gun, which layer is scored to provide the helical main focusing lens, then discarding a completed electron gun is costly.

SUMMARY OF THE INVENTION

An object of the present invention is to improve the reliability of the electrical contact in such electron guns.

According to the present invention there is provided an electron beam device comprising an evacuated envelope formed by an optically transparent faceplate, a conical portion and a neck, an electron gun within the evacuated envelope comprising a tubular body, cup-shaped electrodes provided within the tubular body and electrical connections to the cup-shaped electrodes, characterized in that at least one of the electrical connections comprises a lead-out wire having a terminal portion held captive in the wall of the tubular body and forming a point contact with a skirted portion of its associated cup-shaped electrode, and wherein an area of the internal surface of the wall of the tubular body adjacent the terminal portion is flat.

By the wall portion being generally flat adjacent the point contact then the skirted portions can be made of slightly greater diameter, say 30 μm greater, so that in adapting to the surface of the associated step the skirted portion lies substantially contiguously against it thereby ensuring a more reliable point contact. The flattened area may comprise a chord to the internal curved surface of the tubular body.

In an embodiment of the present invention the portion of the tubular body in which the cup-shaped electrodes are provided is characterized in that it comprises a plurality of stepped abutments of decreasing cross-section viewed from the adjacent end of the tubular body. An alternative embodiment of the present invention is characterized in that the stepped abutments are of increasing cross-section viewed from the adjacent end of the tubular body. In both embodiments a plurality of angularly spaced facets are provided on the axially extending face of each step. The facets on each step may be spaced equi-angularly about the longitudinal axis of the tubular body. If desired the cross-sectional shape of the stepped abutments comprises a polygon, for example a regular hexagon. In the event of two or more connections being made by lead-out wires contacting the skirted portions of respective cup-shaped electrodes, these terminal portions are angularly spaced relative to each other.

The lead-out wires may have a terminal portion lying in the plane of the flat surface.

BRIEF DESCRIPTION OF THE DRAWING

The present invention will now be explained and described, by way of example, with reference to the accompanying drawing figures, wherein.

In the drawing figures, corresponding reference numerals have been used to indicate the same parts.

DESCRIPTION OF THE PREFERRED EMBODIMENTS

Figure 1:
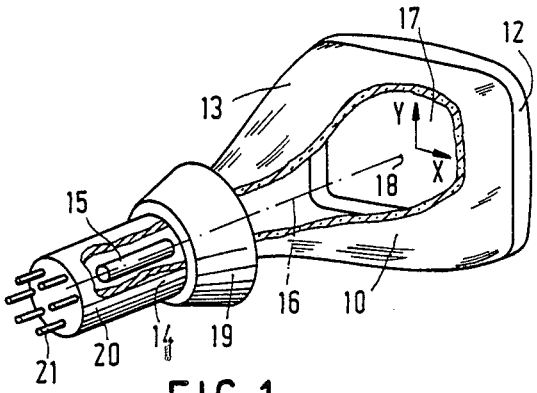
FIG. 1 is a perspective view of a monochrome display tube with part of the envelope wall broken away.

Referring initially of FIG. 1, the monochrome display tube comprises an evacuated envelope 10 formed by an optically transparent faceplate 12, a conical portion 13 and a neck 14. An electron gun 15 is mounted substantially coaxially in the neck 14. An electron beam 16 produced by the electron gun 15 forms a sport 18 on a cathodoluminescent screen 17 provided on the internal surface of the faceplate 12. A magnetic deflection yoke 19 scans the spot 18 in the X and Y directions across the screen 17. External connections to the electrodes of the electron gun 15 are by means of pins 21 in a glass end cap 20 fused to the neck 14.

Figure 2:
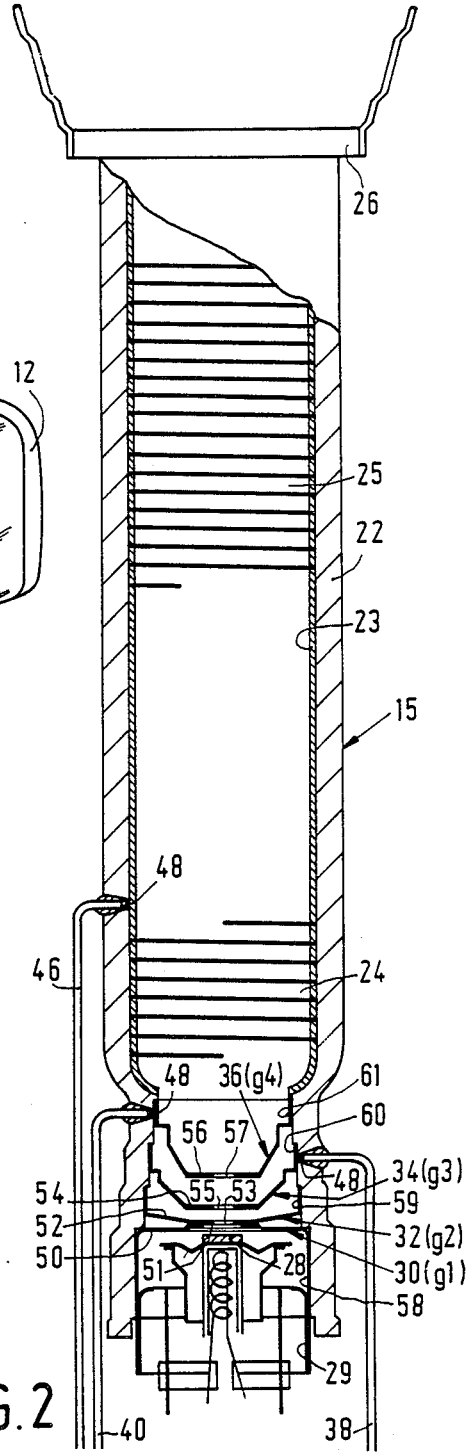
FIG. 2 is a longitudinal cross-sectional view of one embodiment of an electron gun which can be used in the display tube shown in FIG. 1.

FIG. 2 shows the electron gun 15 in greater detail. The electron gun 15 comprises a tubular body 22 of an electrically insulating material, for example a glass tube which is formed by softening a glass tube section and drawing it on a profiled bipartite mandril. Adjacent one end, a series of annular steps of increasing diameter towards the terminal portion of the tube section are formed. The remainder of the tube section has a homogeneous high ohmic resistive layer 23, for example a glass enamel with ruthenium oxide particles, thereon. A pre-focusing lens 24 and a focusing lens 24 are formed as helices in the resistive layer. A centering member 26 with springs which contact a conductive layer on the wall of the envelope 13 is mounted on the end of the tubular body 22.

Figure 3:
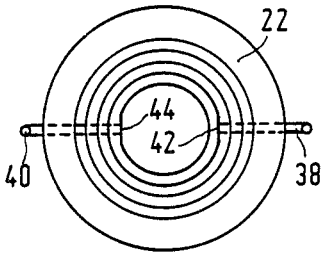
FIG. 3 is an end view of the tubular body forming the electron gun shown in FIG. 2, the cup-shaped electrodes having been omitted.

The beam forming part of the electron gun comprises an indirectly heated cathode 28 which is carried by, and electrically insulated from, a drawn, thin-walled sleeve 29 which is secured to an apertured, drawn thin-walled metal sleeve 30 which constitutes a grid g1. Proceeding in the direction of the electron beam path from the cathode 28, there are successively arranged apertured grids g2, g3 and g4 formed by drawn, thin-wall metal sleeves 32, 34 and 36, respectively. Electrical connections to the grids g3, g4, are via leadout wires 38,40 having terminal portions extending through and held captive by the wall of the tubular body 22. In order to facilitate the electrical contact, facets 42, 44 (FIG. 3) are provided on the internal surface of the tubular body during the drawing operation. Another electrical connection is made to the resistive layer 23 at a point intermediate the helical segments 24, 25 by a lead-out wire 46. The provision of the lead-out wires 38, 40 and 46 involves sand-blasting conical holes at predetermined positions in the tube wall. Indium balls 48 are inserted into the holes together with the respective lead out wires 38, 40, 46 and each assembly is fused in its respective hole by means of a conventional crystallizing glass. Any part of the wires and/or indium balls protruding into the tube are cut-off flush.

The high ohmic resistance layer 23 comprising for example a glass enamel with ruthenium oxide particles, is formed by applying a suspension of ruthenium hydroxide precipitated in a mixture of glass particles and water to the interior of the glass tube and allowed to dry. The helical segments 24, 25 are scored in the resistive layer by rotating the glass tube about its longitudinal axis at a constant speed and scratching the helical form at the area of the segments by means of a chisel which is slowly moved parallel to the axis. Thereafter the tubular body is heated to melt the glass particles so that said glass enamel with ruthenium oxide particles is formed.

The cup-shaped electrodes 30, 32, 34 and 36 comprise short, drawn, thin-walled sleeves having plates 50, 52, 54 and 56, respectively, in the centre of which apertures 51, 53, 55 and 57, respectively, are present to pass the electron beam. Each electrode 30, 32, 34 and 36 has a generally cylindrical skirted portion 58, 59, 60 and 61, respectively. In FIG. 2 the lips of the skirted portions 59, 60, 61, abut their respective steps which define their relative axial positions.

Figure 4:
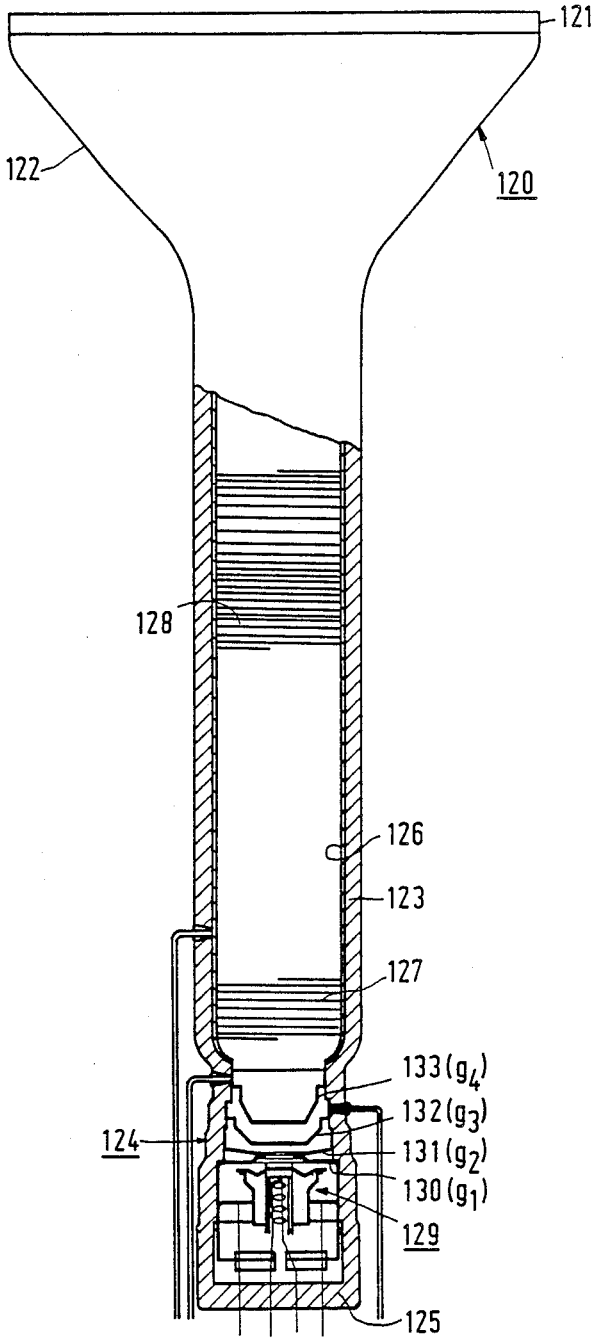
FIG. 4 is a diagrammatic cross-sectional view of a monochrome display tube in which the tubular housing of the electron gun forms a part of the envelope.

Another embodiment of a monochrome display tube according to the invention in which the tubular housing of the electron gun forms a part of the envelope comprises a glass envelope 120 (see FIG. 4) with an optically transparent faceplate 121, a conical portion 122 and a tubular housing 123 in which an electron gun 124 is provided. In the tubular housing 123 a series of annular steps of increasing diameter towards the terminal portion of the tubular housing 123 are formed. The envelope 120 is closed in an air-tight manner by means of a closing plate 125 which is provided at the terminal portion of the tubular housing 123. The remainder of the tubular housing 123 has a homogeneous high ohmic resistance layer 126 on its inner surface. A pre-focusing lens 127 and a focusing lens 128 are formed as helices in the resistive layer 126. The beam forming part of the electron gun 124 comprises an indirectly heated cathode 129, an apertured, drawn thin-walled metal sleeve 130 which constitutes a grid g, and apertured grids $g_2$, $g_3$ and $g_4$ formed by drawn, thin-wall metal sleeves 131 and 133, respectively.

Generally speaking such sleeves are easy and accurate to make, so that the mutual distance of the plates and the concentricity of the apertures after assembly is also determined accurately to within approximately 5 μm. Moreover, these sleeves easily adapt themselves to the respective surfaces of the steps formed in the tubular body 22 during subsequent thermal treatments.

Figure 5:
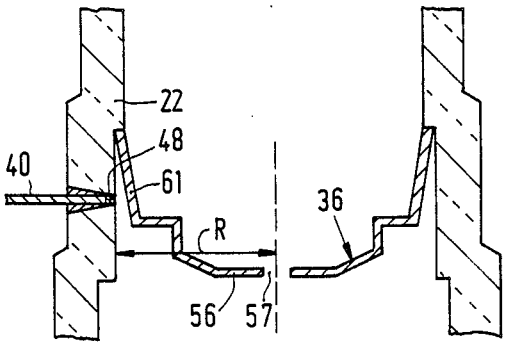
FIG. 5 is a diagrammatic, part sectional view illustrating a cup-shaped electrode having a skirted portion of excessive conicity.

Ideally the skirted portions should be truly cylindrical to enable a good electrical contact to be made with the respective leadout wires. However it is not unusual for the skirted portions of such drawn sleeves to be slightly conical and in certain situations for the conicity to be so large that unless some corrective action is taken, no point contact is achieved. This is illustrated in FIG. 5. The cross-section of the step is circular, having a radius R, and does not have a facet therein.

Figure 6:
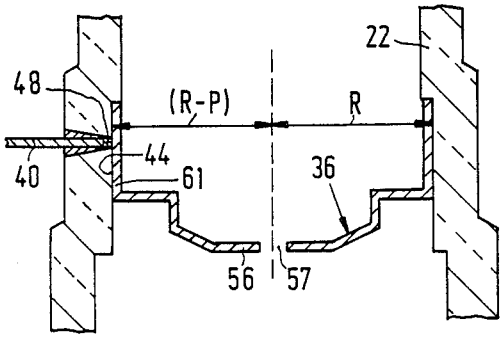
FIG. 6 is a similar view to FIG. 4 but showing the improved point contact obtained by providing a facet on the internal surface of the tubular body.

FIG. 6 illustrates that providing a facet or flat face 44, which forms a chord to the circularly curved surface of the step, enables the skirted portion 61 of the electrode 36 to be locally flattened thereby ensuring that a better point contact can be made. The radial distance to the mid-point of the flat face 44 is (R-P) which is less than R. It has been found that the cup-shaped electrodes 30, 32, 34 and 36 can be made bigger, for example by 30 μm, than would be the case in the situation described with reference to FIG. 5. When these enlarged electrodes are inserted into tubular housing 22 they become deformed slightly as they adapt to the shape of the step against which they abut. As will be described later a plurality of facets may be formed in each step.

Figure 7:
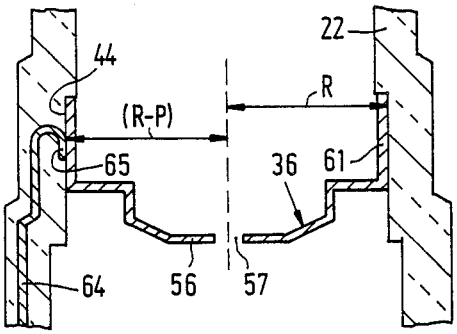
FIG. 7 is a variant of FIG. 5 showing an alternative lead-out wire arrangement.

FIG. 7 shows a variant of FIG. 6 in which a lead-out wire 64 is encapsulated by the wall of the tubular body 22. A terminal portion 65 of the lead-out wire 64 forms part of the facet or flat face 44. Although a substantially point contact is made with the electrode 36, the use of the lead-out wire itself to effect the connection has been found to be more reliable than via the indium ball 48 if for no other reason than the terminal portion 65 is of larger area than the indium ball 48 (FIG. 6).

The encapsulation of the lead-out wire 64 and for that matter any other lead-out wires not extending through the open end of the tubular body 22 is carried-out when drawing the softened glass onto a bipartite suction mandril. More particularly the or each lead-out wire is arranged on the outer surface of a first glass cyclindrical member 70 (FIG. 10) with its terminal portion extending through an aperture provided for example by sand blasting. A second cylindrical member 72 is arranged about the first cylindrical member 70 and is subsequently united with it to form the tubular body 22 under the influence of subatmospheric pressure and elevated temperature.

Figure 8:
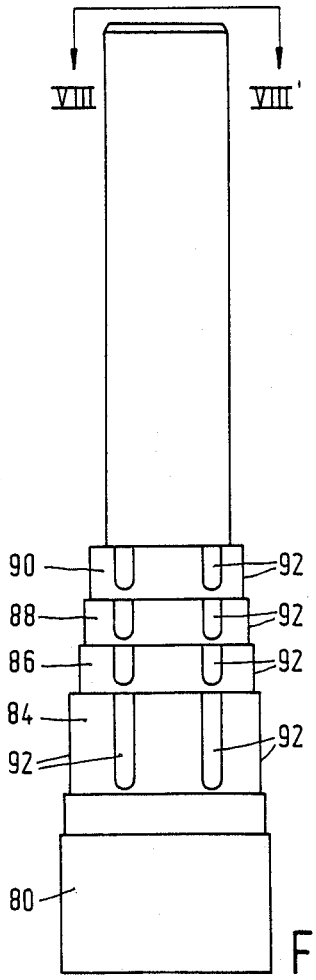
FIGS. 8 and 9 are respectively an elevational view and a top plan view from VIII–VII' in FIG. 7 of one part of a bipartite suction mandril.
Figure 9:
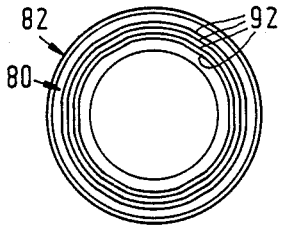

FIGS. 8 and 9 show the stepped part 80 of a bipartite suction mandril 82. The part 80 has four steps 84, 86, 88 and 90 which provide the necessary engagement surfaces for the electrodes 30, 32, 34 and 36, respectively. Each step has six facets or flat faces 92 formed thereon at 60° intervals. The heights of the facets 92 is less than the axial length of the steps. For convenience of manufacture the facets 92 of adjacent steps are aligned.

Figure 10:
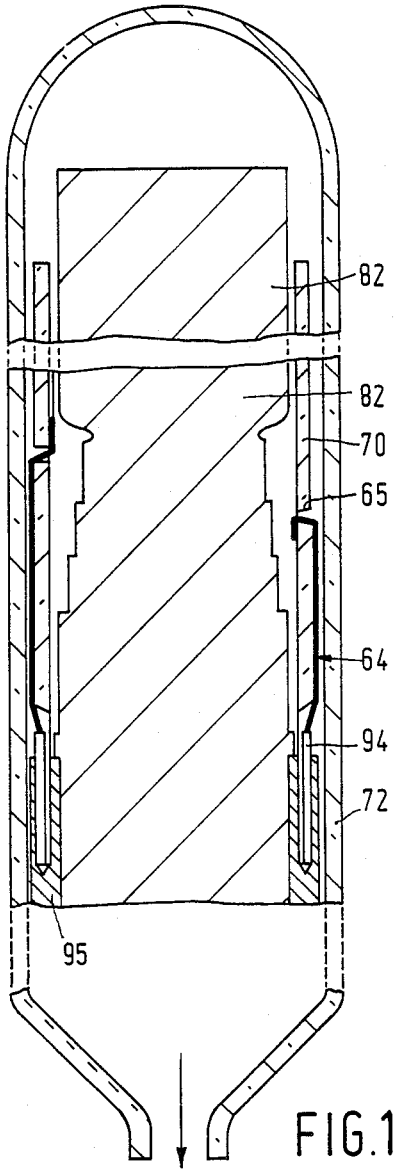
FIG. 10 is a diagrammatic longitudinal cross-sectional view of an arrangement for producing a tubular body having lead-out wires extending within the thickness of its wall.

Referring to FIG. 10, the or each lead-out wire is a flat strip conductor say of 50 μm thick and 1 mm width which is spot or laser welded to a pin 94. The strip conductor has its free end threaded through a predetermined hole in the wall of the first cylindrical member 70 and the pin 94 is placed in one of six equi-angularly spaced holes in an annular pin holder 95. The protruding end of the strip conductor is pressed against the inner surface of the glass cylindrical member 70. When the or all of the lead-out wires are in position, the bipartite suction mandril 82 is inserted into the first cylindrical member which is pressed firmly against the end surface of the holder 95. The mandril 82 and the pin holder 95 together with the first cylindrical member are rotated relative to each other so that each lead-out wire is aligned with a particular row of aligned facets 92 on the steps 84 to 90.

The assembly is then enclosed inside the second cylindrical member 72 which is attached at one end to a vacuum pump and is closed at the other end. The second cylindrical member 72 with the enclosed assembly is evacuated to between $10^{-5}$ and $10^{-6}$ mm Hg and rapidly heated in an oven to about 620° C. As the glass of the respective cylindrical members 70, 72 softens, the members unite to form the profiled tubular body 22 and in so doing encapsulate the leadout wires. After about 26 minutes the heating is terminated. The subatmospheric pressure is maintained during cooling and thereafter, the protruding ends of what was the second cylindrical member are removed and the bipartite mandril 82 is separated and removed along with the pin holder 95.

The tubular body 22 with the lead-out wires emerging on the faceted portions thereof is then further processed as described previously to provide the resistive helices and finally the cup-shaped electrodes are inserted.

Figure 11A:
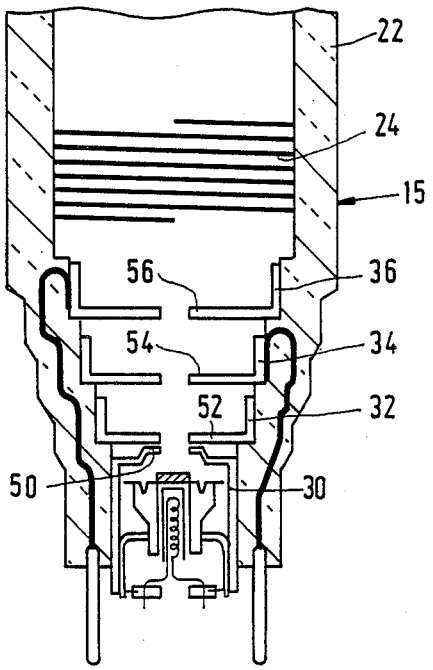
FIGS. 11A and 11B illustrate, respectively, a partial longitudinal sectional view of an electron gun having stepped abutment portions of increasing cross-sectional size progressing from the adjacent end of the tubular body and a one-piece mandril on which these abutment portions are formed.
Figure 11B:
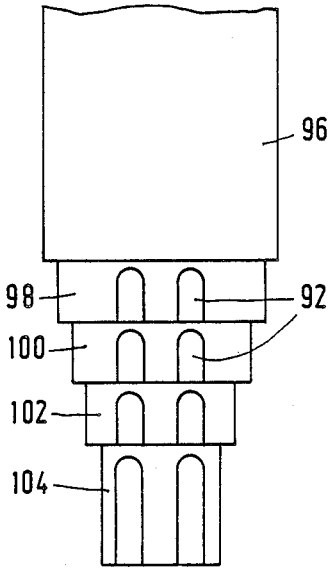

FIG. 11A shows the beam forming part and the prefocusing lens 24 of another embodiment of an electron gun. This embodiment is made in a manner similar to that described with reference to FIG. 9 but, instead of a bipartite mandril, a one part suction mandril 96 (FIG. 11B) is used. Steps 98 to 104 at the end of the mandril 96 are of decreasing cross-sectional area so that when the tubular body 22 has been formed the mandril 96 can be withdrawn through what will be the front end of the eventual electron gun 15. Since the stepped abutments are of decreasing cross-sectional area progressing rearwards then the cup-shaped electrodes 32, 34 and 36 are inserted from the front end beginning with the electrode 32.

Figure 12A:
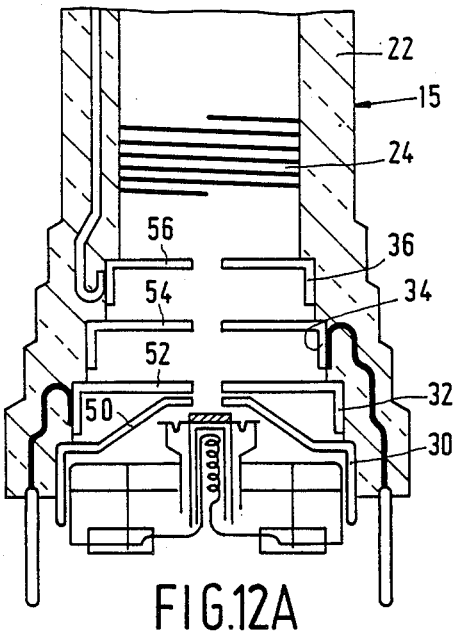
FIGS. 12A and 12B illustrate, respectively, a partial longitudinal sectional view of an electron gun having stepped abutment portions of decreasing cross-sectional size progressing from the adjacent end of the tubular body and a one-piece mandril on which these abutment portions are formed.
Figure 12B:
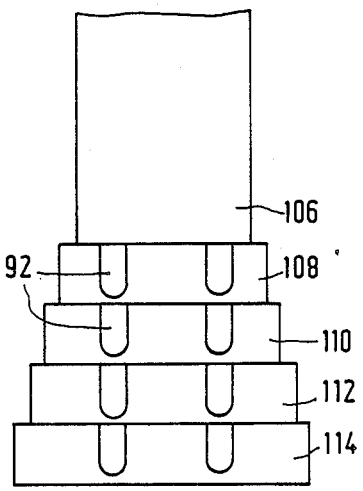

FIG. 12A shows the beam forming part and the prefocusing lens 24 of a further embodiment of an electron gun. This embodiment is made in a manner similar to that described with reference to FIG. 10 but, instead of a bipartite mandril, a one part suction mandril 106 (FIG. 12B) is used. Steps 108, 110, 112 and 114 at the end of the mandril 106 are of increasing cross-section so that when the tubular body 22 has been formed the mandril 106 can be withdrawn through what will be the rear end of the eventual electron gun 15. Since the stepped abutments are of increasing cross-sectional area progressing rearwards then cup-shaped electrodes 30, 32, 34 and 36 are inserted from the rear end beginning with the electrode 36. Since the tubular portion of the body 22 has the smallest cross-sectional area then the focusing lens may exhibit a greater spherical aberration compared to those embodiments in which the tubular portion is of the largest cross-section (FIG. 11A) or can be predetermined independently of the size of the stepped abutments in the beam forming part (FIG. 2).

In FIGS. 11A and 12A the planar parts 52, 54 and 56 (FIG. 11A) and 50, 52, 54 and 56 (FIG. 12A) of the cup-shaped electrodes bear against their respective stepped abutment surfaces. Since these surfaces can be replicated with a high degree of precision, of the order of 5 μm, mounting the cup-shaped electrodes this way around avoids a possible source of error due to variation in the length of the skirted portion of the cup-shaped electrodes. In the embodiment shown in FIG. 2 the cup-shaped electrodes 30, 32, 34 and 36 can also be mounted this way around.

Figure 13:
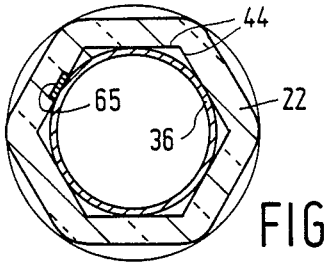
FIG. 13 illustrates diagrammatically a cross-section through an electron gun having a hexagonal stepped abutments and a generally circular cup-shaped electrode.

FIG. 13 illustrates an embodiment in which the flat faces 44 form a regular hexagon and that the terminal portion 65 of the lead-out wire is at the centre of one of the faces 44 so as to be contacted by the inserted electrode 36. Other regular and irregular polygonal cross-sections may be formed in the profiled part of the tubular body 22.

Although in the illustrated and described embodiments the pre-focusing and main focusing lens have been formed by helices, the desired potential distribution can be obtained by varying the resistance of the layer applied to the internal surface of the tubular body for example by varying the thickness or the resistivity of the plain layers and/or helices or by implementing the focusing lens as a plurality of contiguous cylindrical bands of different length, layer thickness and/or resistivity.

Additionally any electrical connections which pass close to the helical lens electrodes ought to have the smallest cross-section possible consistent with the current to be carried and the desire to minimise the effect of any field on the lens itself.

The provision of the facets makes it easier to mount the cup-shaped electrodes which fit better because they can adapt to the slightly larger space. Additionally the cup-shaped electrodes can be made to a slightly greater tolerance especially with respect to their outer dimension. Once fitted a better and more reliable electrical contact is obtained especially with a terminal portion formed by the lead-out conductor itself.

What is claimed is

1. An electron beam device comprising an envelope including, in sequence, a faceplate, a conical portion, and a neck portion, said envelope containing an electron gun at said neck portion, said electron gun comprising:

a. a elongated body consisting essentially of an electrical insulating material, and tubular body having a longitudinal axis and including an inner surface defining a plurality of electrode-receiving positions disposed along said axis, said inner surface having a flat area at at least one of said positions;

b. a plurality of cup-shaped electrodes disposed along the inner surface of the tubular body at respective ones of said positions at least one of said electrodes having a skirt portion conforming to said flat area of the inner surface; and c. at least one lead-out conductor having a terminal portion held captive in the tubular body and extending through an opening in the inner surface at the flat area and making contact with said skirt portion.

2. A device as claimed in claim 1, characterized in that the tubular body is of circular cross-section and the flat area forms a chord of the circular cross-section.

3. A device as claimed in claim 1 or 2, characterized in that the inner surface comprises a plurality of stepped abutments of decreasing cross-section viewed from one end of the tubular body, an axially extending face of each abutment having at least one of said flat areas.

4. A device as claimed in claim 1 or 2, characterized in that the inner surface comprises a plurality of stepped abutments of increasing cross-section viewed from one end of the tubular body, an axially extending face of at least one abutment having a plurality of said flat areas.

5. A device as claimed in claim 3 characterized in that an equal plurality of axially aligned plate areas are provided on each stepped abutment.

6. A device as claimed in claim 3, characterized in that the point contact to each cup-shaped electrode is at a different angular position about the longitudinal axis of the tubular body.

7. A device as claimed in claim 3 characterized in that the flat internal surface areas on each abutment comprise a polygon.

8. A device as claimed in claim 7, wherein the polygon comprises a regular hexagon.

9. A device as claimed in claim 3, characterized in that each of the cup-shaped electrodes comprises a planar portion which bears against the step formed in the respective abutment surface.

10. A device as claimed in claim 3 characterized in that a lip of the skirt portion of each of the cup-shaped electrodes bears against the step formed in the respective abutment surface.

11. A device as claimed in claim 1 or 2, characterized in that the terminal portion of the lead-out wire lies in the plane of the flat internal surface area.

12. A device as claimed in claim 1 or 2, characterized in that the tubular body forms an integral part of the neck portion of the envelope.

* * * * *